US007968046B2

(12) United States Patent
Ebner et al.

(10) Patent No.: US 7,968,046 B2
(45) Date of Patent: Jun. 28, 2011

(54) APPARATUS FOR COOLING A METAL STRIP

(75) Inventors: Peter Ebner, Leonding (AT); Gerald Eckertsberger, Wilhering (AT)

(73) Assignee: Ebner Industrieofenbau Ges.m.b.H, Leonding (AT)

( * ) Notice: Subject to any disclaimer, the term of this patent is extended or adjusted under 35 U.S.C. 154(b) by 157 days.

(21) Appl. No.: 11/989,653

(22) PCT Filed: Jul. 14, 2006

(86) PCT No.: PCT/AT2006/000302
§ 371 (c)(1),
(2), (4) Date: Jan. 29, 2008

(87) PCT Pub. No.: WO2007/014406
PCT Pub. Date: Feb. 8, 2007

(65) Prior Publication Data

US 2009/0115113 A1 May 7, 2009

(30) Foreign Application Priority Data

Aug. 1, 2005 (AT) ..... A 1288/2005
Apr. 21, 2006 (AT) ..... A 678/2006

(51) Int. Cl.

| | |
|---|---|
| ***C21D 1/62*** | (2006.01) |
| *C21B 7/10* | (2006.01) |
| *C21D 9/56* | (2006.01) |
| *C21D 1/06* | (2006.01) |
| *C21D 9/00* | (2006.01) |

(52) U.S. Cl. ..... 266/259; 266/46; 266/111; 266/251; 148/559

(58) Field of Classification Search ..... 148/559; 266/251, 259, 46, 111
See application file for complete search history.

(56) References Cited

U.S. PATENT DOCUMENTS 3,897,906 A 8/1975 Bachner
(Continued)

FOREIGN PATENT DOCUMENTS

EP 0 761 829 3/1997
(Continued)

OTHER PUBLICATIONS

International Search Report.

*Primary Examiner* — Jessica L Ward
*Assistant Examiner* — Alexander Polyansky
(74) *Attorney, Agent, or Firm* — Collard & Roe, P.C.

(57) ABSTRACT

An apparatus is described for cooling a metal strip (1), comprising at least two nozzle fields which are disposed opposite of each other with respect to the metal strip (1) conveyed continuously in its longitudinal direction and which comprise nozzles facing towards the respective strip surface and being attached to blowing boxes (3) for a cooling gas, and flow conduits (5) provided between the nozzles for discharging the cooling gas flows from the nozzles which are deflected on the surface of the strip. In order to provide advantageous cooling conditions it is proposed that the nozzles are combined in groups in nozzle strips (4) which are disposed next to one another in parallel with lateral distance and which consist of gas conduits (6) connected with the blowing boxes (3) and comprising nozzle openings (7) facing the respective strip surface and being distributed over the length of the nozzle strips (4), and that the flow conduits (5) for discharging the cooling gas flows are provided between the nozzle strips (4) extending transversally to the blowing boxes (3).

7 Claims, 9 Drawing Sheets

U.S. PATENT DOCUMENTS

| | | | | |
|---|---|---|---|---|
| 4,625,431 | A | 12/1986 | Nanba et al. | |
| 5,137,586 | A | 8/1992 | Klink | |
| 5,871,686 | A | 2/1999 | Nivoche | |
| 5,885,382 | A | 3/1999 | Sakurai et al. | |
| 6,054,095 | A | 4/2000 | Minato et al. | |
| 6,309,483 | B1 | 10/2001 | Wang et al. | |
| 6,358,465 | B1 * | 3/2002 | Paulus | 266/111 |
| 2003/0047642 | A1 * | 3/2003 | Ebner | 242/615.11 |

FOREIGN PATENT DOCUMENTS

| | | |
|---|---|---|
| EP | 1 029 933 | 8/2000 |
| EP | 1 375 685 | 1/2004 |
| FR | 1 337 313 | 7/1962 |
| FR | 2 238 550 | 2/1975 |
| JP | 09-194954 | 7/1997 |
| WO | WO 01/09397 | 2/2001 |
| WO | WO 2004/029305 | 4/2004 |

* cited by examiner

APPARATUS FOR COOLING A METAL STRIP

1. FIELD OF THE INVENTION

The invention relates to an apparatus for cooling a metal strip, comprising at least two nozzle fields which are disposed opposite of each other with respect to the metal strip conveyed continuously in its longitudinal direction and which comprise nozzles facing towards the respective strip surface and being attached to blowing boxes for a cooling gas, and flow conduits provided between the nozzles for discharging the cooling gas flows from the nozzles which are deflected on the surface of the strip.

2. DESCRIPTION OF THE PRIOR ART

In order to prevent microstructural formations or precipitations after a heat treatment of metal strips, and of steel in particular, such metal strips need to be cooled very rapidly, which occurs with the help of a protective gas which is usually a mixture of hydrogen and oxygen for preventing oxidation reactions in the area of the surface of the strip. In order to achieve the required cooling-down gradients which for steel strips with a strip thickness of 1 mm lie from 50 up to 150° C./s depending on the composition of the alloy, the cooling gas needs to be blown with rapid speed against the surface of the strip and needs to be removed from there again. For this purpose it is known (EP 1 029 933 B1) to provide blowing boxes which extend on either side of the metal strip in its longitudinal direction, which when positioned in a row are spaced from one another with lateral distance and which comprise flat-jet nozzles facing towards the respective strip surface and extending transversally to the longitudinal direction of the strip. These flat-jet nozzles of the individual blowing boxes which are disposed successively behind one another at a distance in the longitudinal direction of the strip complement one another into continuous rows of nozzles which extend transversally to the longitudinal direction of the strip. The cooling gas which flows from the flat-jet nozzles and is deflected on the strip surface can thus be removed between the rows of nozzles. Apart from the fact that in comparison with flat-jet nozzles with nozzle fields made of round jet nozzles it is generally possible to achieve a more even application of the strip surface with the cooling gas, the flow conduits obtained between the individual rows of nozzles are penetrated in this known apparatus by the blowing boxes, leading to uneven flow-off conditions which are accompanied by the likelihood that as a result of uneven cooling there will be warping of the strip, requiring subsequent straightening of the metal strip.

SUMMARY OF THE INVENTION

The invention is thus based on the object of providing an apparatus for cooling a metal strip of the kind mentioned above in such a way that even cooling of the metal strip can be ensured with a high cooling-down gradient without any likelihood of warping of the strip.

This object is achieved by the invention in such a way that the nozzles are combined in groups in nozzle strips which are disposed next to one another in parallel with lateral distance and which consist of gas conduits connected with the blowing boxes and comprising nozzle openings facing the respective strip surface and being distributed over the length of the nozzle strips, and that the flow conduits for removing the cooling gas flows are provided between the nozzle strips extending transversally to the blowing boxes.

By using gas conduits for the nozzle strips forming the cooling gas, nozzle fields with round jet nozzles can be simply provided, which are obtained by nozzle openings arranged in the nozzle strips and are distributed over the length of the nozzle strips. Advantageous removal of the cooling gas flow deflected on the strip surface is ensured by the spaces between the adjacently disposed nozzle strips, which cooling gas flows can be removed with a comparatively low pressure loss through the flow conduits between the nozzle strips. As a result of the round jet nozzles and the removal of the cooling gas flows between the nozzle strips which deflected on the strip surface, advantageous cooling conditions can be maintained for the metal strip, so that an even cooling of the metal strip can be ensured without any likelihood of warping.

In order to exclude any disadvantageous influence of the blowing boxes on the removal of the cooling gas, the nozzle strips can be connected at one of their face sides with the blowing boxes. In this case, the blowing boxes are situated outside of the flow area of the cooling gas flowing away from the nozzle strips. It is also possible to connect the nozzle strips in the middle of their longitudinal extension to the blowing boxes, which facilitates chaining the nozzle strips in their longitudinal direction by maintaining the nozzle distance beyond the chained nozzle strips. In order to ensure that an even cooling gas flow to the individual nozzle openings can be maintained within the nozzle strips, the nozzle strips may taper in their flow cross section towards their end starting from their connection to the respective blowing box.

In order to create especially advantageous constructional conditions, it can also be provided that the nozzle strips which are each provided with two rows of nozzles staggered against each other form the nozzles between two longitudinal wall sections with bulging portions which each complement the respective nozzle conduit and that the longitudinal wall sections which are between the bulging portions in a boundary section produce the separating walls connecting the nozzles of the two nozzle rows in an alternating manner, of which the longitudinal wall sections run apart to the longitudinal walls of the gas conduit. Since as a result of this measure only the face surfaces of the longitudinal edges of the longitudinal wall sections face towards the surface of the strip and said longitudinal wall sections rest against each other in a boundary section between the individual nozzles which thus leads to the consequence that perpendicularly extending separating walls are obtained in the area of the boundary sections resting against each other, which walls join the nozzles of the two rows in an alternating manner, the cooling gas flows which are deflected evenly in the case of round jet nozzles to all sides on the surface of the strip are split into two partial flows by the separating walls in the area of the nozzles strips in a manner which is advantageous to the flow, which partial flows are removed via the flow conduits between the nozzle strips. The longitudinal wall sections which move apart from the boundary sections in contact with each other to the longitudinal walls of the gas conduits for guide surfaces for the return flow of the cooling gas flows which flow along the deflected cooling gas flows to the flow conduits between the nozzle strips, which occurs with a reduced formation of eddy currents which supports the outflow.

The nozzles themselves are not formed by a nozzle opening but in addition by a nozzle conduit which is each obtained between the mutually oppositely paired bulging portions of the two longitudinal wall sections of each nozzle strip. This ensures an outlet direction determined by the alignment of the nozzle conduit for the cooling gases irrespective of the cross-sectional progress of the nozzle strip in the area of the nozzles, especially when the height of the separating walls as measured in the direction of the nozzle axes corresponds at least to the mean diameter of the nozzles because in this case the nozzle conduits have a minimum length corresponding to their mean diameter, which separating walls are formed by the longitudinal wall sections of the nozzle strips which rest on each other.

Since the separating walls connect the nozzles of the two nozzle rows of each nozzle strip in an alternating manner with each other, the bulging portion of the longitudinal wall section on the outside averted from the other row of nozzles would become larger than the inside facing the other row of nozzles in the case of a progress of the separating wall through the axes of the directly connected nozzles, which—when the bulging portions are embossed—would lead to different loads of the longitudinal wall sections on the outside and inside. In order to avoid the thus resulting disadvantages, the abutting surfaces between the longitudinal wall sections forming the nozzles can be situated in the area of the individual nozzles in a diametrical plane of the nozzles extending in the longitudinal direction of the nozzle strip, so that symmetrical conditions are obtained with respect to the bulging portions of the two longitudinal wall sections of the nozzle strips, which bulging portions are situated opposite each other in pairs.

BRIEF DESCRIPTION OF THE DRAWINGS

The subject matter of the invention is shown by way of example in the drawings, wherein.

DESCRIPTION OF THE PREFERRED EMBODIMENTS

Figure 1:
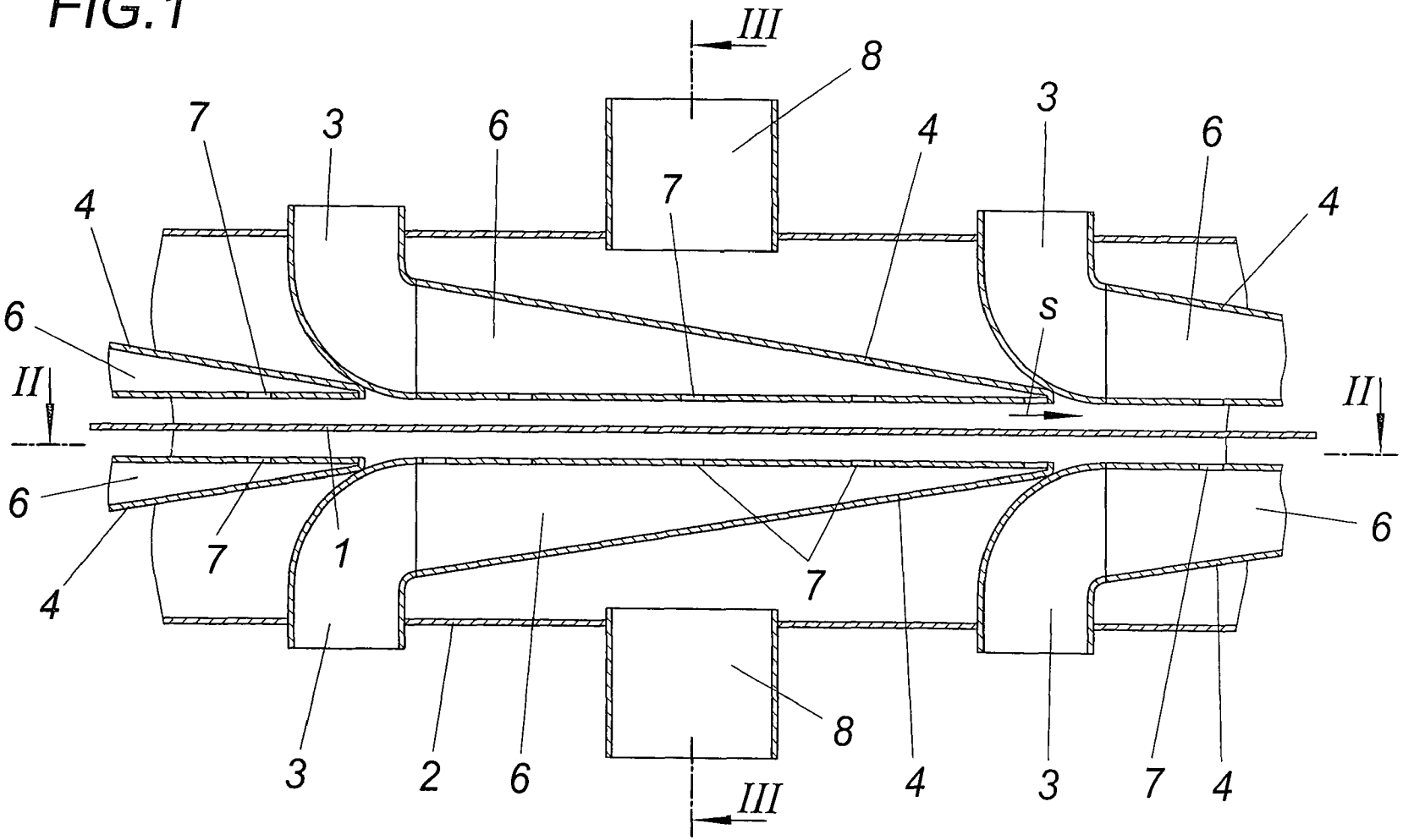
FIG. 1 shows a simplified longitudinal sectional view of an apparatus in accordance with the invention for cooling a metal strip.
Figure 2:
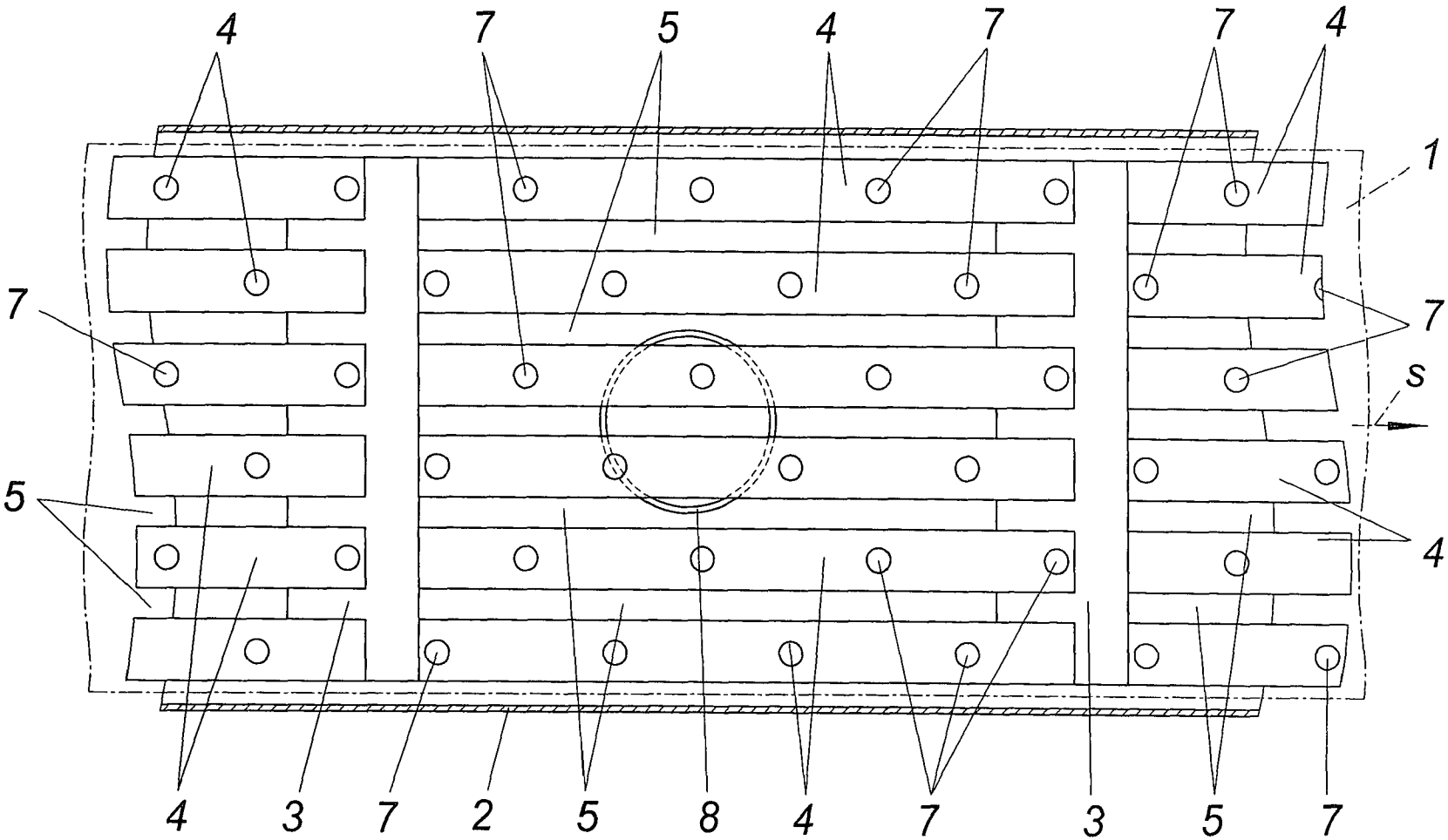
FIG. 2 shows this apparatus in a sectional view along line II-II in FIG. 1.
Figure 3:
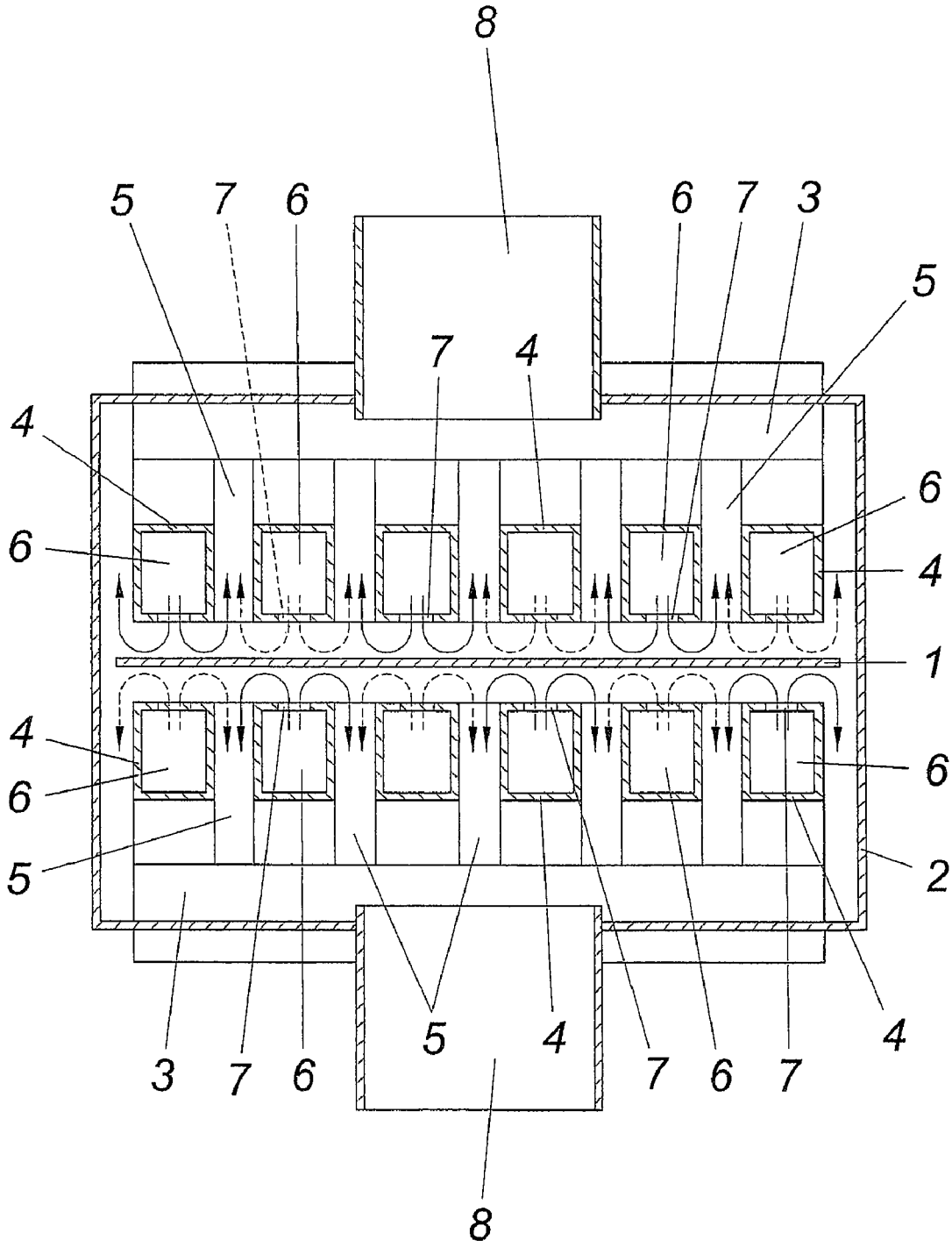
FIG. 3 shows a sectional view along line III-III of FIG. 1.

The illustrated cooling apparatus for a metal strip 1 comprises in accordance with FIGS. 1 to 3 a housing 2 through which the metal strip 1 to be cooled is conveyed in a continuous manner in the feeding direction s. Blowing boxes 3 for a cooling gas such as a gas mixture of 95% by volume of nitrogen and 5% by volume of hydrogen are provided on either side of the metal strip 1. Nozzle strips 4 are connected to said blowing boxes 3 which extend next to one another in parallel and form flow conduits 5 between themselves. The nozzle strips 4 themselves are arranged in the form of a gas conduit 6 which is rectangular in its cross section and which tapers away from the blowing boxes 3 and comprises round nozzle openings 7 on the side facing the metal strip 1. The nozzle openings 7 are distributed over the length of the nozzle strips 4 connected to the respective blowing box 3 and are arranged in a row, so that a nozzle field is obtained with round jet nozzles which are distributed evenly over a surface section of the metal strip 1, as is shown especially in FIG. 2. The nozzle openings 7 of adjacent nozzle strips 4 are provided with a staggered configuration.

The cooling gas streams flowing from the nozzle openings 7 against the strip surface are deflected on the strip surface and removed from the metal strip 1 through the flow conduits 5 between the nozzle strips 4, as is indicated by the flow arrows in FIG. 3. Since the housing 2 forms a collecting chamber for the removed cooling gas flows, the cooling gas can be removed from the housing 2 via discharge nozzles 8. According to the embodiment, the nozzle strips 4 extend in the longitudinal direction of the metal strip 1, i.e. in the direction of feed, which thus allows, among other things, the formation of nozzles 7 with flow cross sections which differ over the length of the nozzle strips without having to fear any uneven cooling of the strip because due to the fact that the nozzle strips 4 are the same among each other an even distribution of the flow of the cooling gas is ensured transversally to the longitudinal direction of the strip. Moreover, the cooling apparatus can be adjusted in a simple manner to different strip widths when nozzle strips 4 on the boundary side are blocked off from the associated blowing boxes 3, so that these nozzle strips 4 outside of the width of the metal strip 1 are no longer supplied with cooling gas. The alignment of the nozzle strips 4 in the longitudinal direction of the metal strip 1 is not mandatory.

Figure 4:
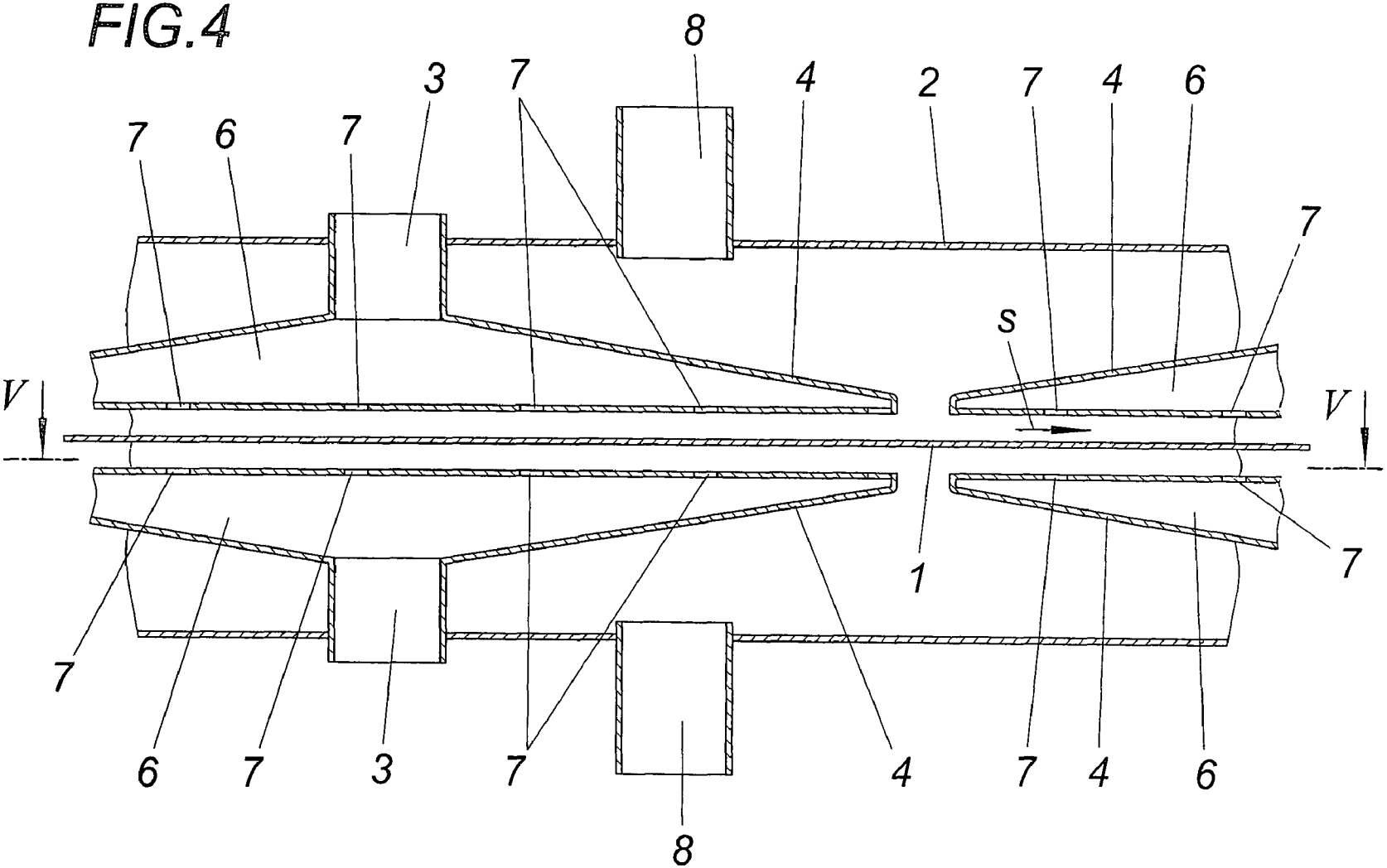
FIG. 4 shows an illustration according to FIG. 1 in an embodiment of an apparatus in accordance with the invention.
Figure 5:
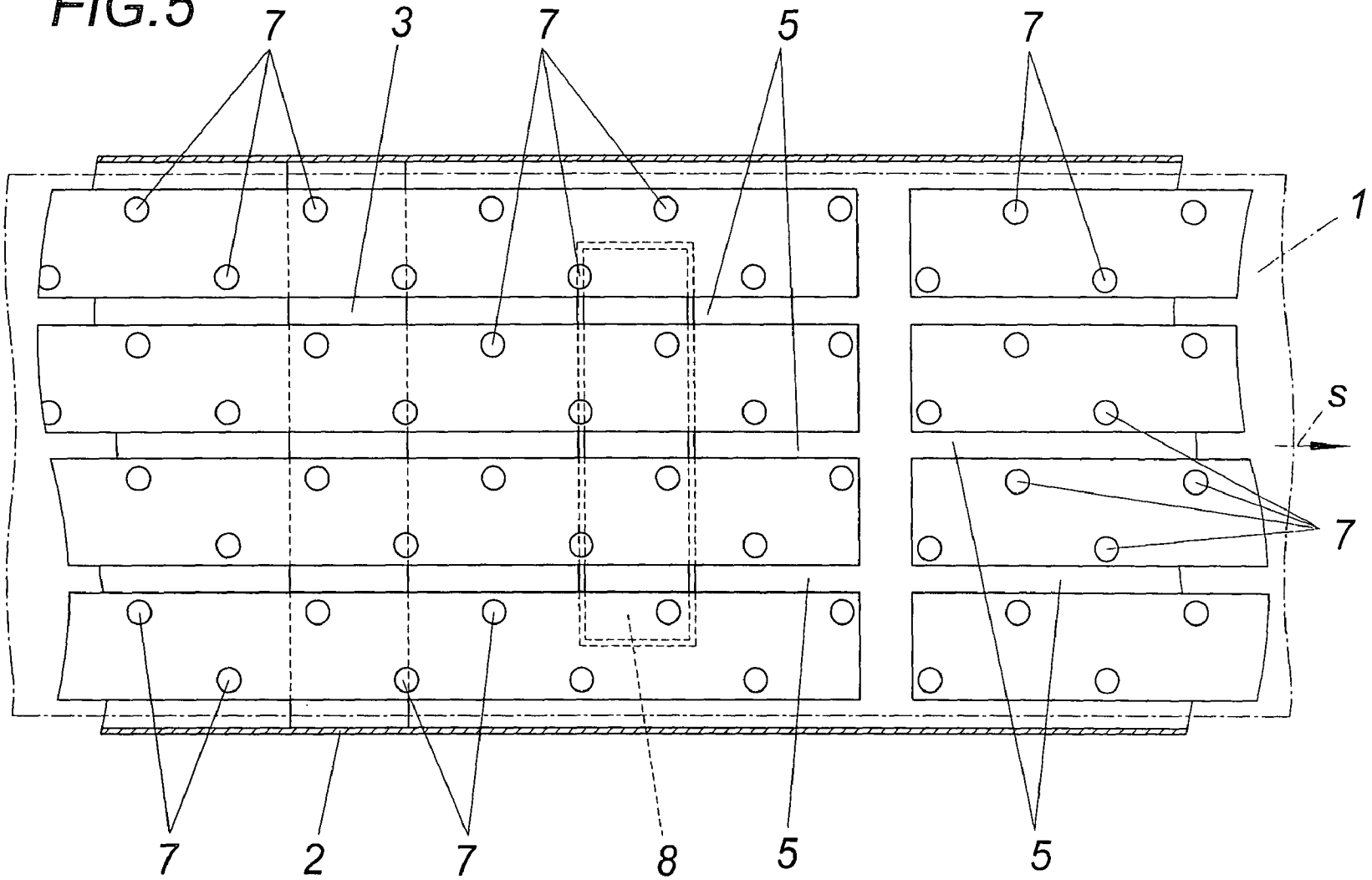
FIG. 5 shows a sectional view along line V-V of FIG. 4.
Figure 6:
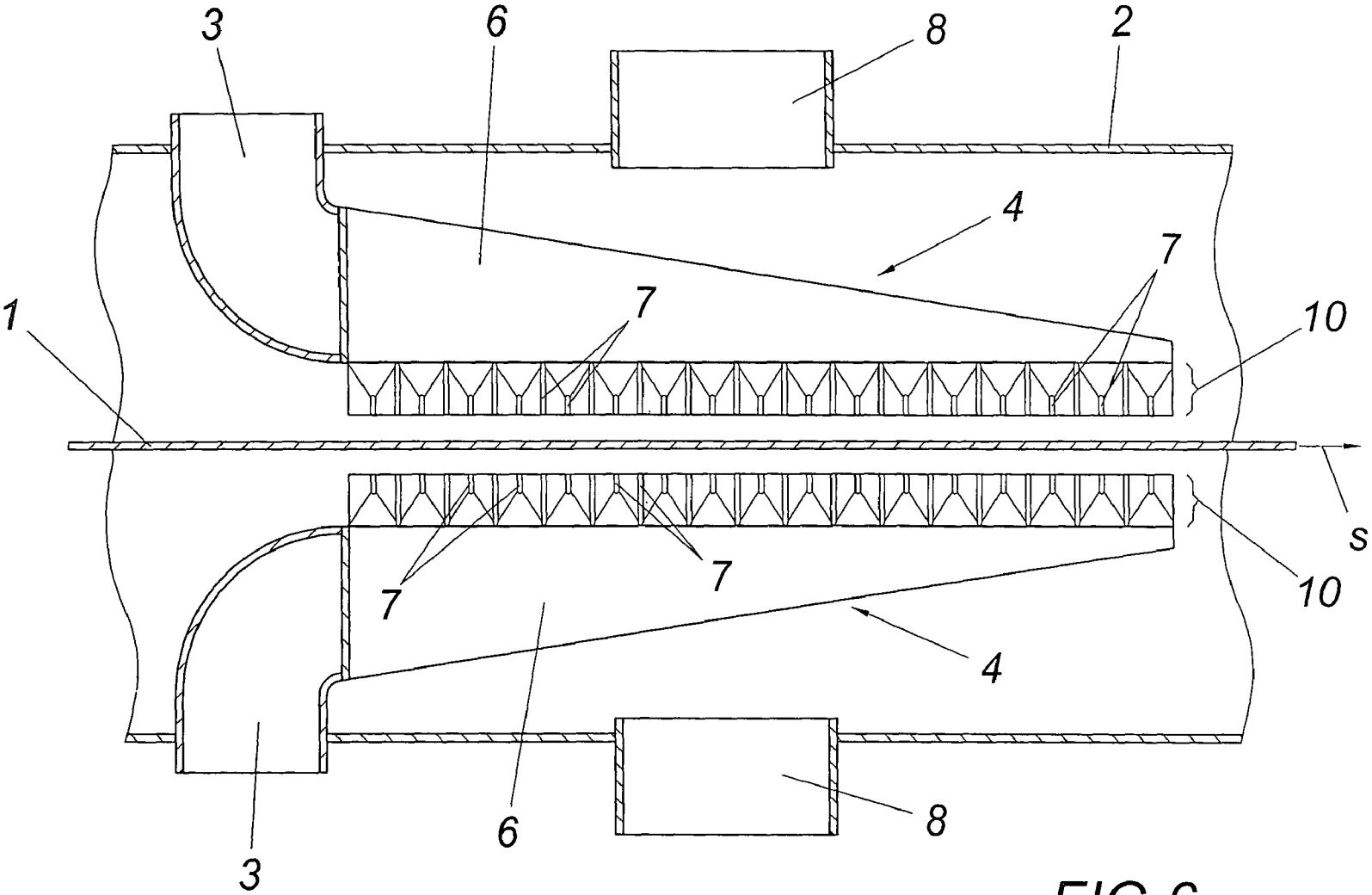
FIG. 6 shows a nozzle strip of a further embodiment of an apparatus in accordance with the invention in a schematic side view.
Figure 7:
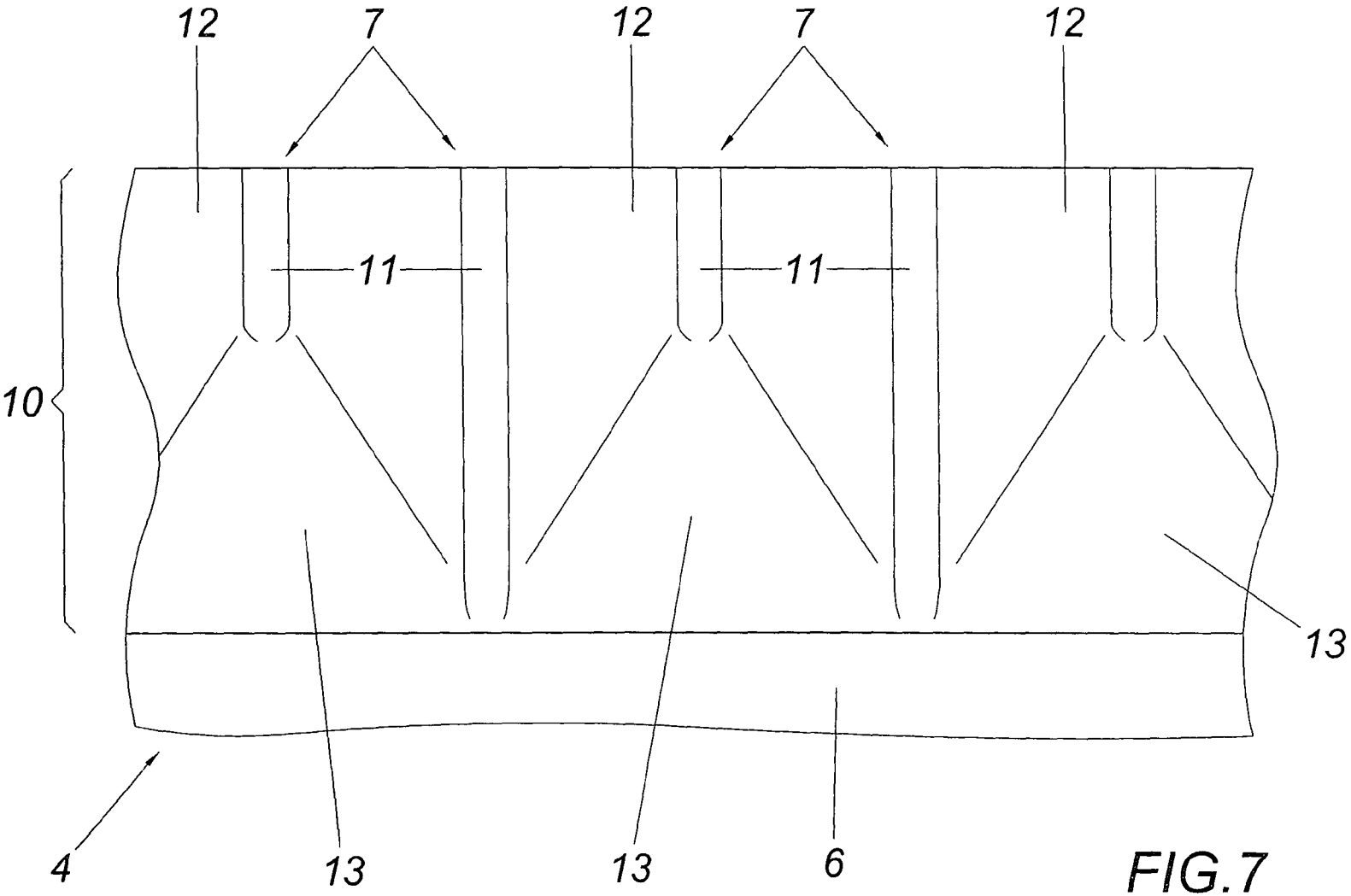
FIG. 7 shows a side view on an enlarged scale of the nozzle strip according to FIG. 6 in sections in the area of the longitudinal wall sections forming the nozzle strips.

The embodiment according to FIGS. 4 and 5 differs substantially from the one according to FIGS. 1 to 3 only by the shape of the nozzle strips 4 which are connected to the blowing boxes 3 in the center of their longitudinal extension. The gas conduit 6 of the nozzle strips 4 thus extends to both sides of the associated blowing box 3, thus again leading to a tapering towards the ends of the gas conduit 6 in order to achieve an even supply of the nozzle openings 7. As is shown in FIG. 5, two rows of nozzle openings 7 are provided for each nozzle strip 4, with the nozzle openings 7 of the two rows being provided with a staggered arrangement. Coinciding nozzle strips 4 can be used with such an arrangement of the nozzle openings 7, thus simplifying production.

According to the embodiment in accordance with FIGS. 6 to 9, the nozzle field is formed by nozzle conduits 9 which are distributed evenly over the surface section of the metal strip 1. In accordance with FIG. 9, the cooling gas flows exiting from the nozzle conduits 9 against the strip surface are deflected on the strip surface again and removed from the metal strip 1 through flow conduits 5 between the nozzle strips 4, as is indicated by the flow arrows.

The individual nozzles 7 of each nozzle strip 4 are formed between two longitudinal wall sections 10 of the nozzle strips 4. These longitudinal wall sections 10 are provided with bulging portions 11 which are situated opposite of each other in pairs and complement the nozzle conduits 9 and between which the longitudinal wall sections 10 rest on each other in a boundary section, and the nozzles 7 of the two nozzle rows lead to separating walls 12 which connect each other in an alternating manner, as is shown especially in FIG. 8. The longitudinal wall sections 10 move away from each other to the longitudinal walls 14 of the gas conduits 6 of the nozzle strips 4 from said separating walls 12 by forming guide surfaces 13 for the cooling gas flows. The separating walls 12 thus divide the cooling gas flows deflected on the strip surface in the area of each nozzle strip 4 into two partial streams and remove them according to the illustration in FIG. 9 to both sides of the nozzle strips 4, thus creating advantageous flow conditions for the return flow of the deflected cooling gas flows. As a result of the longitudinal wall sections 10 which move apart relative to the longitudinal walls 14 of the gas conduit 6, dissymmetry occurs in the inflow region of the individual nozzle conduits 9 which may have a disadvantageous effect on the alignment of the cooling gas flows exiting from nozzles 7. In order to exclude such a disadvantageous influence, the nozzle conduits 9 can have a minimum length which corresponds to their mean diameter.

Figure 8:
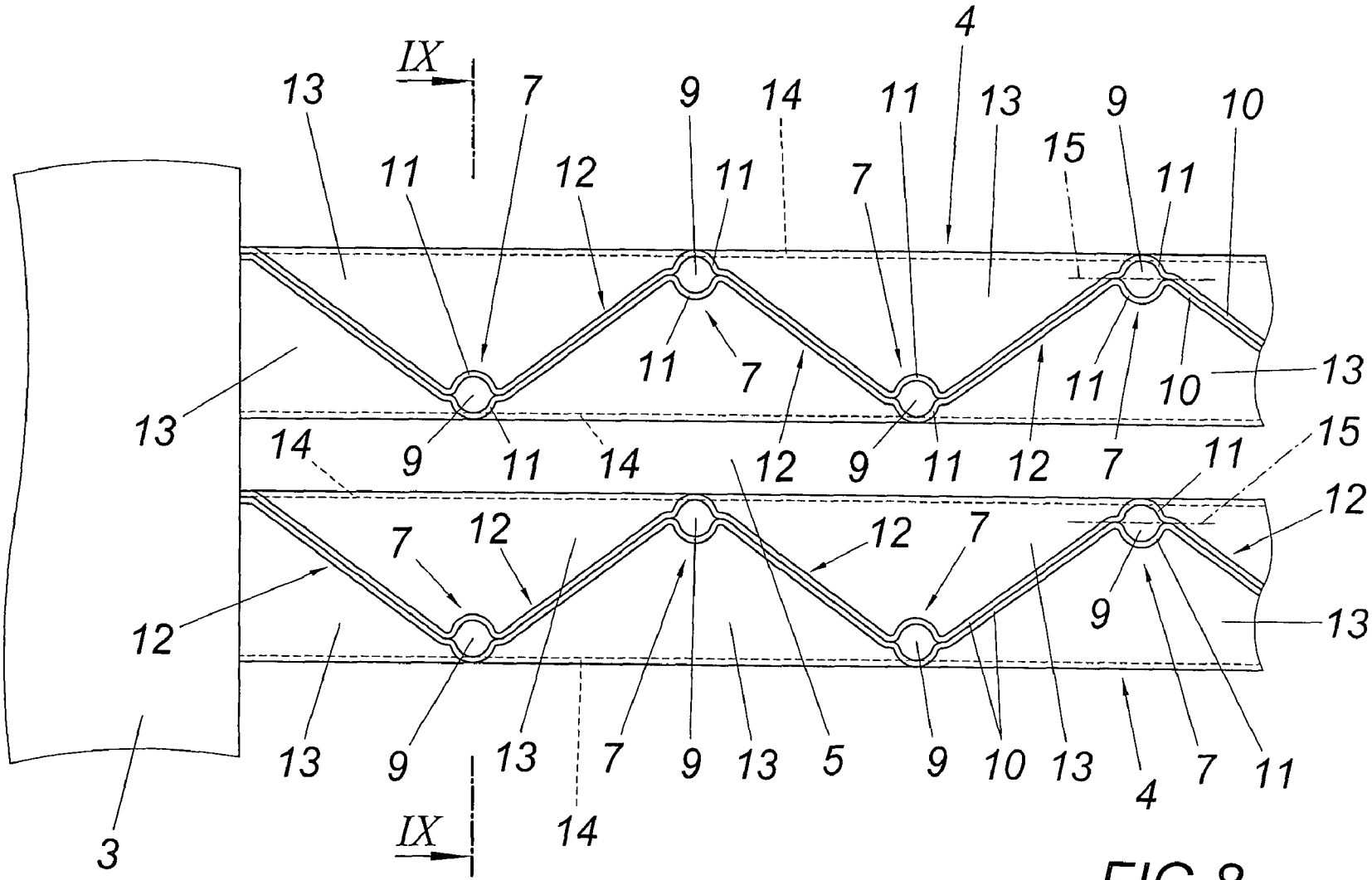
FIG. 8 shows a top view of the nozzle strip according to FIG. 7.
Figure 9:
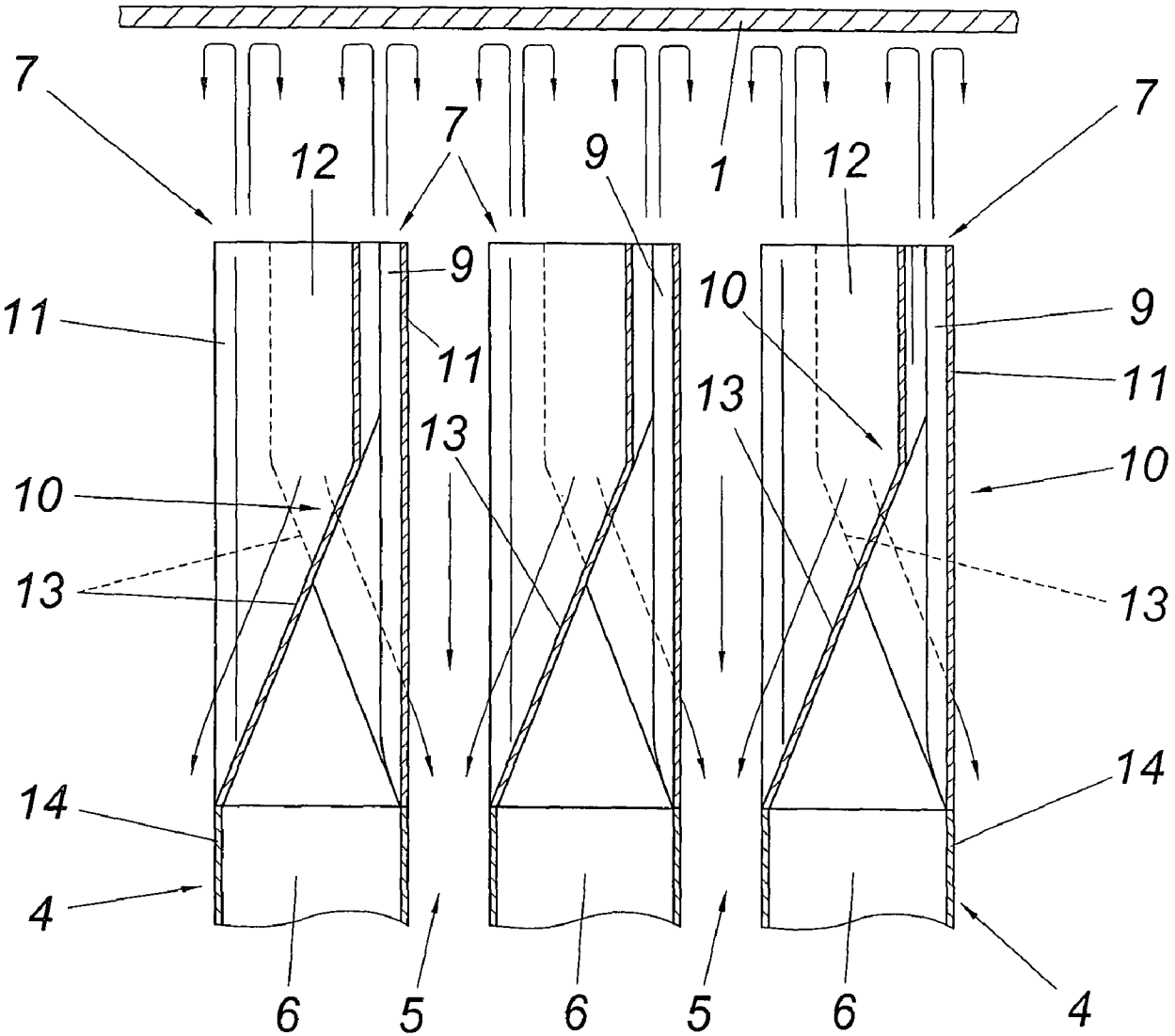
FIG. 9 shows a sectional view along line IX-IX of FIG. 8.

FIG. 8 shows that the abutting surfaces 15 between the longitudinal wall sections 10 in the area of the nozzles 7 lie in a diametrical plane of the nozzle conduits 9 which extend in the longitudinal direction of the nozzle strips 4. This constitutes an advantageous precondition for an even formation of the bulging portions 11 which are situated opposite of each other in pairs and thus a more even loading of the two longitudinal wall sections 10 during the embossing of the bulging portions 11.

The invention claimed is:

1. An apparatus for cooling a metal strip, comprising at least two nozzle fields disposed opposite of each other with respect to the metal strip conveyed continuously in a longitudinal feeding direction of the metal strip, the at least two nozzle fields comprising nozzles facing towards the respective strip surface and being attached to blowing boxes for a cooling gas, and flow conduits provided between the nozzles for discharging deflected cooling gas from the nozzles, the deflected cooling gas being deflected on the surface of the strip, wherein the nozzles are combined in groups in nozzle strips disposed next to one another in parallel with respective lateral spaces being formed between adjacent nozzle strips, the nozzle strips comprising gas conduits connected with the blowing boxes and comprising nozzle openings facing the respective strip surface and being distributed over the length of the nozzle strips, wherein each flow conduit of the flow conduits for discharging the cooling gas is provided in a respective lateral space of the lateral spaces between the adjacent nozzle strips extending transversely to the blowing boxes, and each flow conduit is defined by side walls of adjacent nozzle strips wherein said side walls of adjacent nozzle strips are not in contact with each other, and wherein each nozzle field has at least one blowing box arranged transversely to the feeding direction and connected to a plurality of the nozzle strips extending in the feeding direction.

2. The apparatus according to claim 1, wherein the nozzle strips are connected to the blowing boxes on one of their face sides.

3. The apparatus according to claim 1, wherein the nozzle strips are connected to the blowing boxes in the middle of their longitudinal extension.

4. The apparatus according to claim 1, wherein the nozzle strips taper in their flow cross section towards their end starting from their connection to the respective blowing boxes.

5. The apparatus according to claim 1, wherein the nozzle strips are each provided with two rows of nozzles staggered against each other and form the nozzles between two longitudinal wall sections with bulging portions, the bulging portions each complementing the respective nozzle conduit, and wherein the longitudinal wall sections rest on each other between the bulging portions at least in a boundary section and produce the separating walls connecting the nozzles of the two nozzle rows in an alternating manner, the longitudinal wall sections running apart to the longitudinal walls of the gas conduit.

6. The apparatus according to claim 5, wherein the height of the separating walls as measured in the direction of the nozzle conduits corresponds at least to the mean diameter of the nozzles, which separating walls are formed by the longitudinal walls section of the nozzle strips resting on each other.

7. The apparatus according to claim 5, wherein the abutting surfaces between the longitudinal wall sections forming the nozzles are situated in the area of the individual nozzles in a diametrical plane of the nozzles extending in the longitudinal direction of the nozzle strip.

* * * * *